US005813351A

United States Patent [19]

Chen

[11] Patent Number: 5,813,351

[45] Date of Patent: Sep. 29, 1998

[54] RACETRACK STRUCTURE

[76] Inventor: Yu-Bing Chen, 6th Fl., No.59, Sec. 4, Hsinyi Rd., Taipei, Taiwan

[21] Appl. No.: 796,819

[22] Filed: Feb. 6, 1997

[51] Int. Cl.[6] ..... A63G 31/00

[52] U.S. Cl. ..... 104/60; 191/22 R; 238/10 A; 472/85

[58] Field of Search ..... 104/53, 60, 295, 104/304, 305, DIG. 1; 191/22 R; 238/10 R, 10 A, 10 B, 10 C, 10 E, 10 F, 14.05; 446/444, 445, 446; 472/85

[56] References Cited

U.S. PATENT DOCUMENTS

| | | | |
|---|---|---|---|
| 914,058 | 3/1909 | Martyne | 104/60 |
| 1,911,241 | 5/1933 | Rosenthal | 238/10 A |
| 1,911,242 | 5/1933 | Rosenthal | 238/10 A |
| 1,914,116 | 6/1933 | Ford | 238/10 A |
| 2,401,468 | 6/1946 | Duffy | 238/10 E |
| 2,616,630 | 11/1952 | Michele | 238/10 A |
| 2,618,437 | 11/1952 | Matthaesis | 238/10 A |
| 2,998,196 | 8/1961 | Eenigenburg | 238/10 A |
| 4,415,157 | 11/1983 | Lahr | 238/10 A |
| 4,937,207 | 6/1990 | Simmell et al. | 104/305 |

*Primary Examiner*—Mark Tuan Le
*Attorney, Agent, or Firm*—Abelman, Frayne & Schwab

[57] ABSTRACT

A racetrack structure includes several track sections, the track sections are engaged with each other by hinges, therefore the racetrack can be folded for storage. Each of the track sections of the racetrack structure has PC boards provided at two ends thereof, thereby forming an electrical loop by utilizing the PC boards electrically connected to each other by the hinges. By such arrangement, oxidization of the contact points is low.

7 Claims, 5 Drawing Sheets

RACETRACK STRUCTURE

BACKGROUND OF THE INVENTION

1. Field of the Invention

The present invention relates to a racetrack used for toy racing cars, more particularly, to a racetrack structure with high reliability and being easily stored.

2. Description of Related Art

Electrical toy racing cars provide a very popular game and various racetracks for the toy racing cars have been developed. For example, a conventional racetrack is designed to be a closed loop with at least two lanes. A base disposed with the lanes is provided with a control panel and a PC board. Movement of respective toy racing cars provided on the respective lanes is controlled via circuits on the PC board and the control panel.

A racetrack includes several types of track sections to be assembled as a whole, such as linear track sections, U-turn track sections, curved track sections and a gyratory track sections. The various track sections of the conventional racetrack are assembled by utilizing engaging components provided between the track sections respectively. By such arrangement, the racetrack can be disassembled into sections for storage. Connecting terminals are provided at the ends of each track section of racetrack for forming an electrical loop when the track sections are assembled and the connecting terminals contact with each other.

However, it takes a lot time to assemble or disassemble such racetrack since it is separated into several sections. A dislocation is apt to occur between the track sections when assembling the racetrack. Furthermore, it is inconvenient to store the separate track sections of the racetrack.

In addition, the connecting terminals are completely open to the external environment when the racetrack is disassembled into sections, thus the connecting terminals are apt to be oxidized since they are often exposed to the air with large area, so the reliability of electrical conduct is reduced.

SUMMARY OF THE INVENTION

One object of the present invention is to provide an improved racetrack structure, which is easily stored without disassembling the racetrack.

Another object of the present invention is to provide an improved racetrack structure, which provides an electrical loop with high reliability of electrical conduct.

In accordance with one aspect of the present invention, the racetrack structure comprises several track sections, and the track sections are engaged with each other by hinges.

In accordance with another aspect of the present invention, each of the track sections of the racetrack structure has PC boards provided at two ends thereof, whereby forming an electrical loop by utilizing the PC boards electrically connected to each other by the hinges. By such arrangement, oxidization of the contact points can is low.

Other objects, advantages and novel features of the invention will become more apparent from the following detailed description when taken in conjunction with the accompanying drawings.

DETAILED DESCRIPTION OF PREFERRED EMBODIMENT

Figure 1:
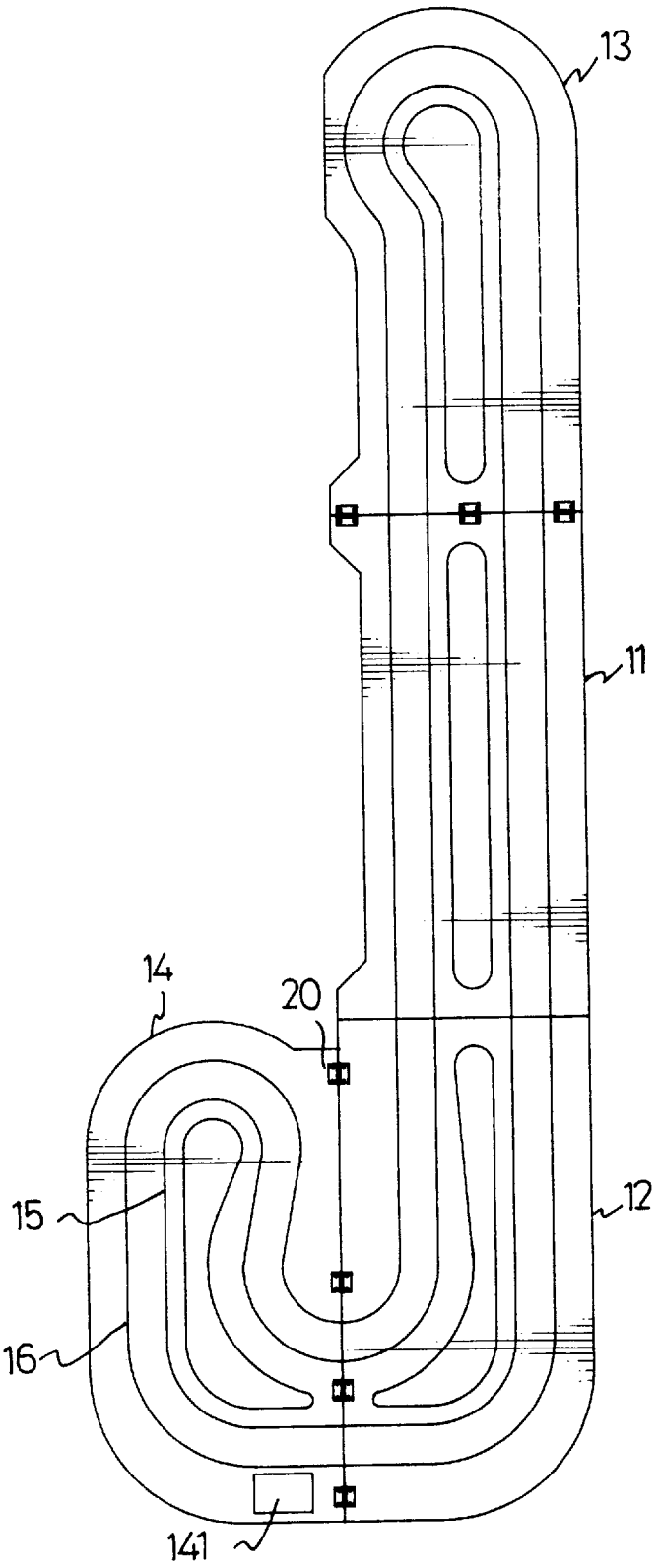
FIG. 1 is a plane view of the racetrack structure of an embodiment in accordance with the present invention.

The racetrack of the present invention can be composed of linear track sections, curved track sections, U-turn track sections and gyratory track sections. As shown in FIG. 1, an embodiment of the present invention comprises a U-turn track section 13, a linear track section 11, a curved track section 12 and a gyratory track section 14 assembled to be a closed loop. The racetrack of this embodiment comprises two lane A and B (15, 16), however, there can be any number of lanes. Each of the track sections comprises a section of the lane A (15) and a section of the lane B (16). The respective track sections are engaged with each other by means of hinges 20. A control panel 141 having circuits inside for controlling toy racing cars moving on the lanes A, B is provided on the gyratory track section 14.

Figure 2:
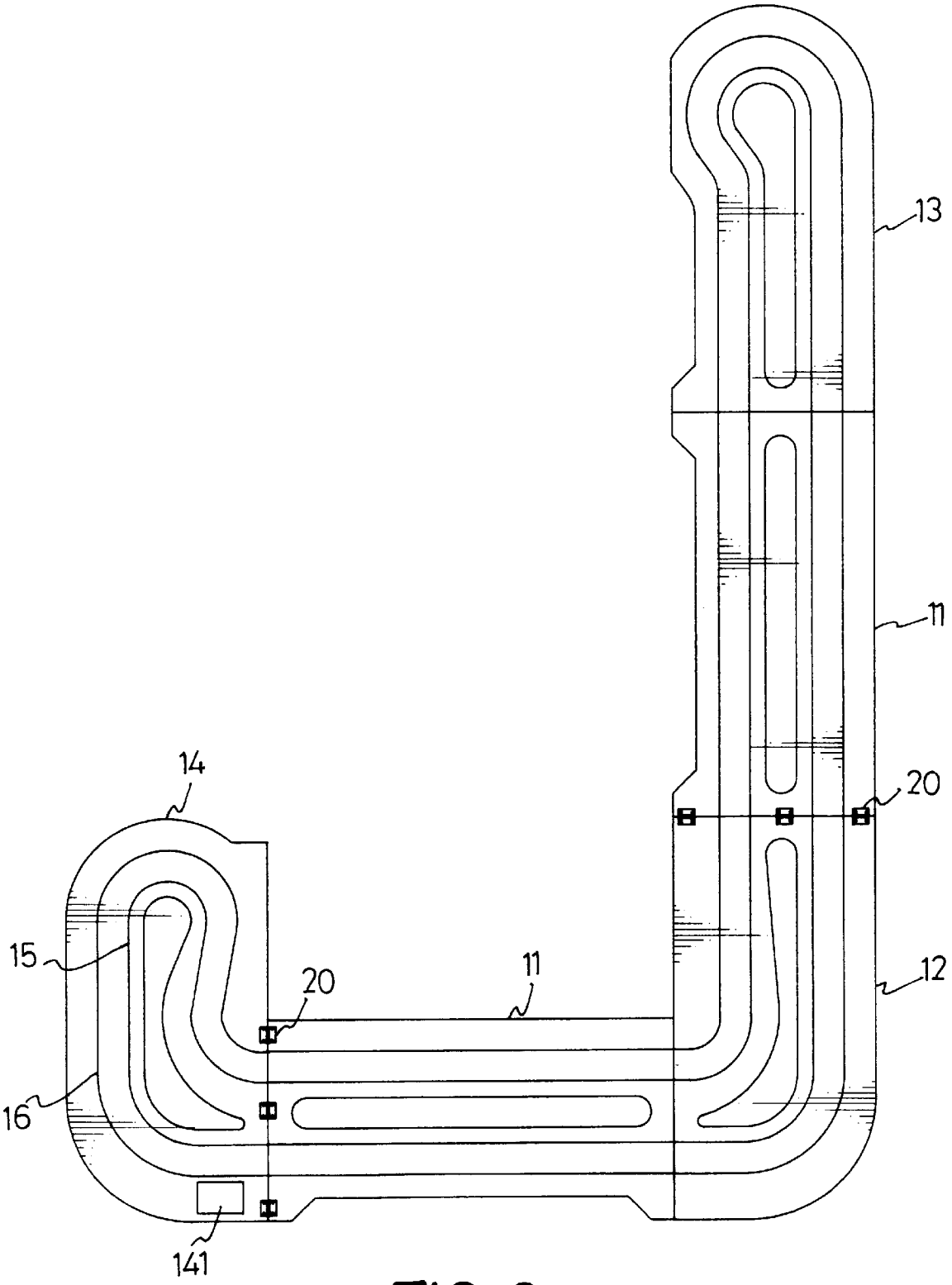
FIG. 2 is a plane view of the racetrack structure of another embodiment in accordance with the present invention.

As can be seen in FIG. 2, various track sections can be arranged as required. In FIG. 2, there is one more linear track section 11 provided between the curved track section 12 and the gyratory track section 14 in comparison to the racetrack in FIG. 1.

Figure 3:
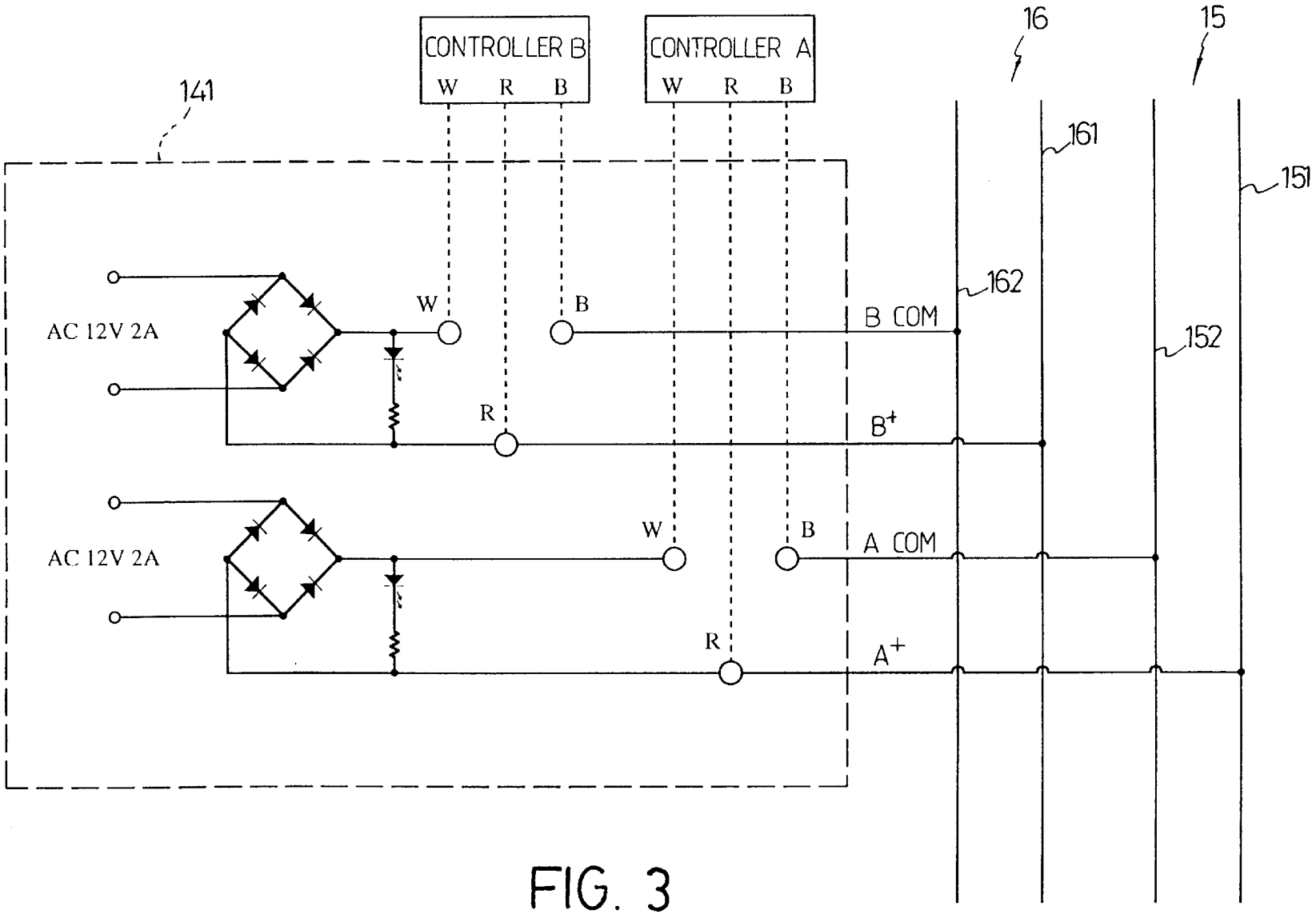
FIG. 3 is a schematic view of a control circuit of the racetrack structure of the present invention.

Referring to FIG. 3, a dashed block indicates the circuit of the control panel 141. The control panel can be connected with two external controllers, for example, controller A and controller B, which control the toy racing cars on the lanes A and B, respectively. A wire 151 connected with a terminal A+ of the control panel 141 and a wire 152 connected with a terminal A com thereof are provided at two sides of the lane A, respectively. A wire 161 connected with a terminal B+ of the control panel 141 and a wire 162 connected with a terminal B com thereof are provided at two sides of the lane B. Accordingly, the wires 151 and 152 (and the wires 161 and 162) are substantially parallel to each other.

The engagement between the track sections 11 and 12 will be taken as an example to describe the engaging manner between the track sections of the racetrack of the present invention as follows.

Figure 4:
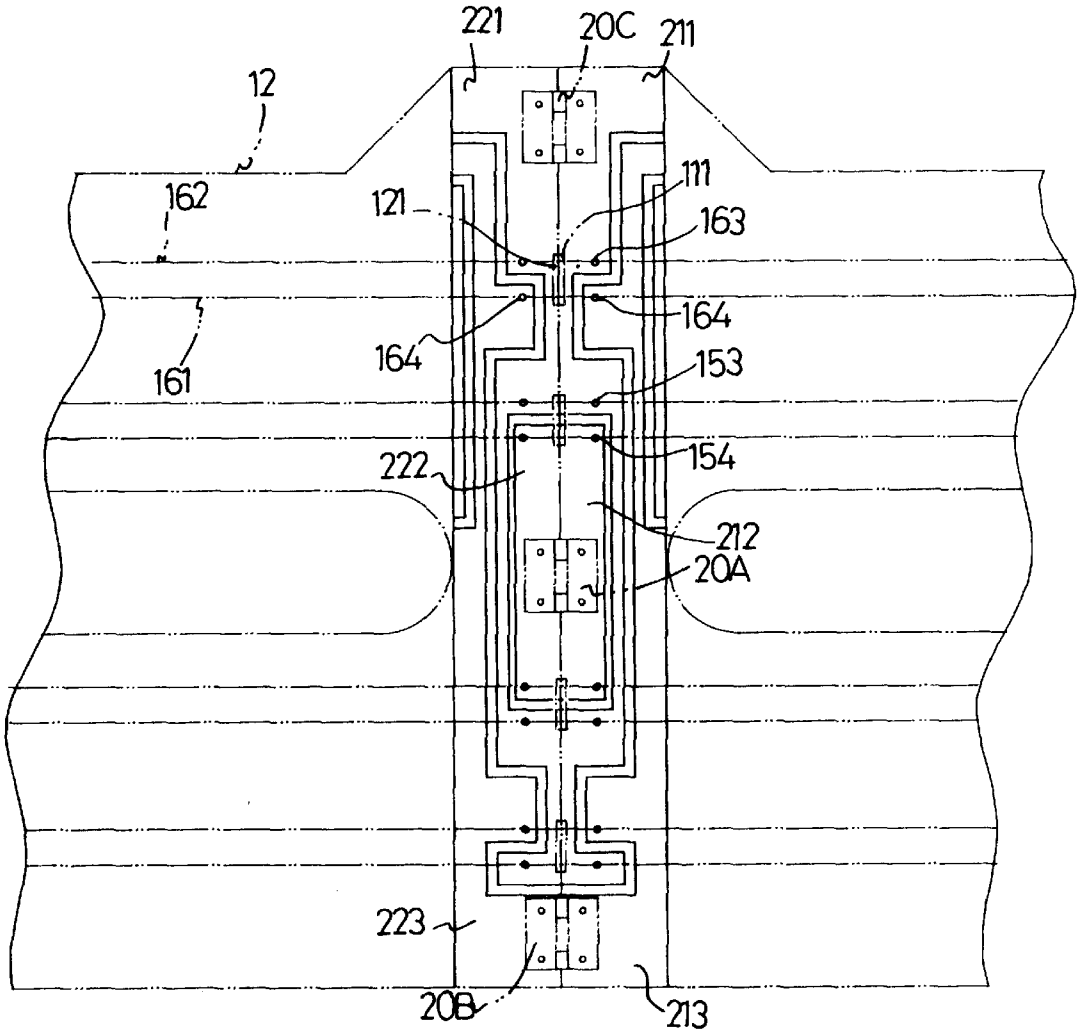
FIG. 4 is a partial plane view showing the engagement between two track sections by means of hinges and PC boards.

Referring to FIG. 4, the track sections 11 and 12 are combined with three hinges 20.

The respective track sections 11, 12 respectively have recesses 111 and 121. Each recess 111 of the track section 11 and each recess 121 of the track section 12 define a slot in common when the track sections 11 and 12 are in an operation position, that is, the sections are unfolded for use. Accordingly, the wires 151, 152, 161 and 162 do not continue along the entire length of the racetrack.

Figure 6:
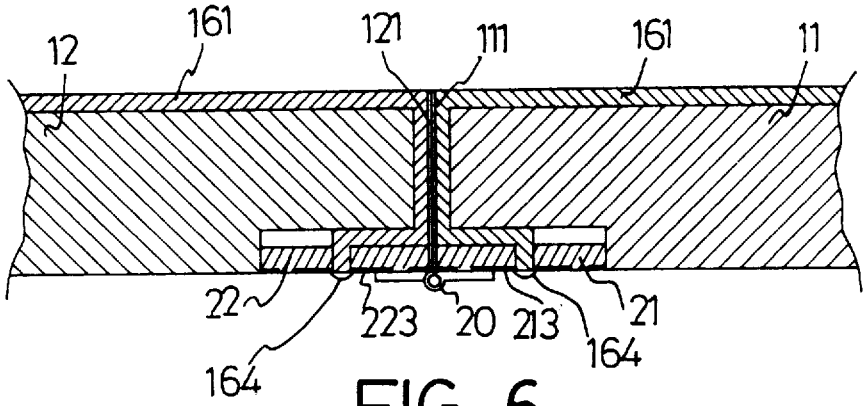
FIG. 6 is another cross-sectional view showing the connection between two track sections by utilizing a hinge and PC boards.

Referring to FIG. 6, the wire 161 at the track section 11 side extends downward along the recess 111 and is connected to a PC board 21 disposed on a bottom surface of the track section 11 by being soldered at the solder point 164 on a copper foil 213 of the PC board 21. The wire 161 at the track section 12 side extends to be connected to a PC board 22 by being soldered at a solder point 164' on a copper foil 223 of the PC board 22. The copper foils 213 and 223 are electrically connected with each other by means of the metal hinge 20 fixed thereon.

Figure 5:
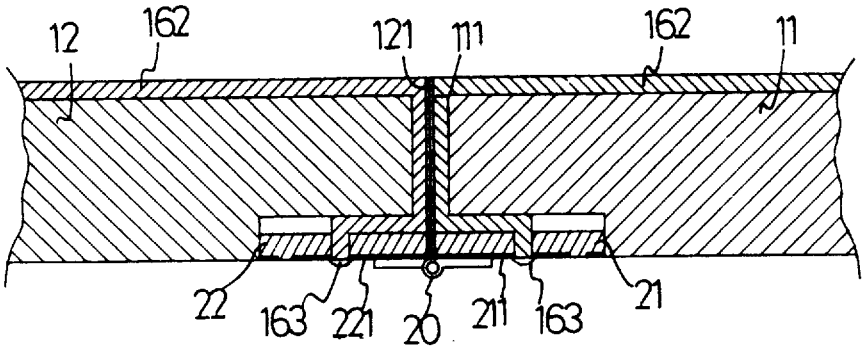
FIG. 5 is a cross-sectional view showing the connection between two track sections by utilizing a hinge and PC boards.

Referring to FIG. 5, the wire 162 at the track section 11 side extends downward along the recess 111 and is connected to the PC board 21 disposed on a bottom surface of the track section 11 by being soldered at the solder point 163 on a copper foil 211 of the PC board 21. The wire 162 at the track section 12 side extends to be connected to the PC board 22 by being soldered at a solder point 163' on a copper foil 221 of the PC board 22. The copper foils 211 and 221 are electrically connected with each other by means of the metal hinge 20 fixed thereon.

Figure 7:
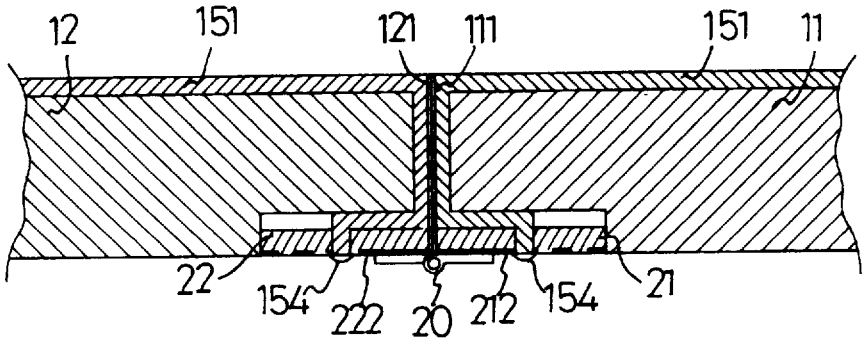
FIG. 7 is a further cross-sectional view showing the connection between two track sections by utilizing a hinge and PC boards.

Referring to FIG. 7, the wire 151 at the track section 11 side extends downward along the recess 111 and is connected to the PC board 21 disposed on a bottom surface of the track section 11 by being soldered at the solder point 154 on a copper foil 212 of the PC board 21. Likely, the wire 151 at the track section 12 side extends to be connected to the PC board 22 by being soldered at a solder point 154' on a copper foil 222 of the PC board 22. The copper foils 212 and 222 are electrically connected with each other by means of the metal hinge 20 fixed thereon.

Accordingly, the problem that the contacts may oxidize is avoided. The situation for the wire 152 is similar to the above, and therefore the description thereof is omitted.

Figure 8:
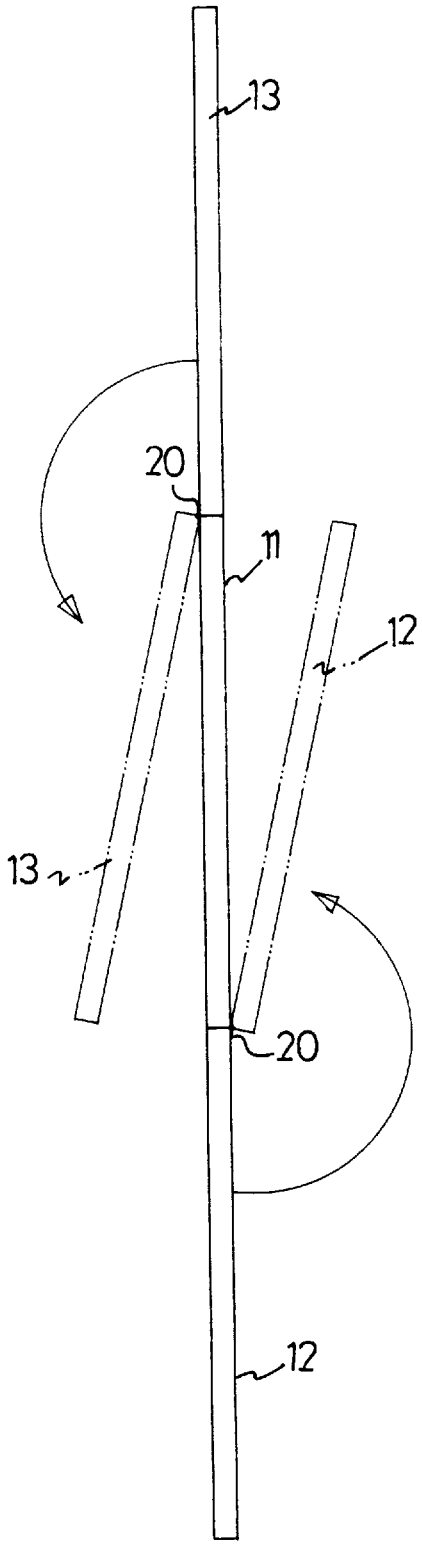
FIG. 8 is a side view showing how to fold the racetrack structure for storage.

Referring to FIG. 8, the racetrack can be folded since the track sections are engaged with each others by hinges 20. Therefore, it is easy and convenient to fold and store the racetrack.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An improved racetrack structure comprising:

a closed loop with at least one lane, each lane being for a toy racing car to run therealong;

a control circuit for controlling the at least one lane so as to control the movement of said racing car on said at least one lane, said control circuit having a plurality of terminals;

wherein said closed loop is composed of a plurality of track sections, said track sections are engaged with each other by hinges, whereby said race track structure can be folded; each of two ends of each of said track sections has a PC board, each of said track sections has a plurality of conductors, two ends of each of said conductors are connected to said PC boards at the two ends of one of said track sections, respectively, the two PC boards of the adjacent ends of two adjacent ones of said track sections are electrically connected with each other via said hinges, and said conductors are electrically connected to said terminals of said control circuit respectively, thereby forming an electrical loop.

2. The racetrack structure according to claim 1, wherein each said end of each said track section has a recess defined so the conductors of the track section are not connected directly with the conductors of the adjacent track section.

3. The racetrack structure according to claim 2, wherein said conductors for each said lane on the track section are disposed along edges of the lane and along respective ones of the recesses and connected to respective ones of the PC boards.

4. The racetrack structure according to claim 1, wherein said track sections comprise linear track sections, curved track sections, U-turn track sections and gyratory track sections.

5. The racetrack structure according to claim 1, wherein said closed loop has a first lane and a second lane, said control circuit has a first terminal and a second terminal for said first lane, and a third terminal and a fourth terminal for said second lane, and each of said track sections has a first, second, third and fourth conductor electrically connected to said first, second, third and fourth terminals respectively.

6. The racetrack structure according to claim 5, wherein said second terminal and said fourth terminal are common.

7. The racetrack structure according to claim 6, wherein each of said PC boards has a first copper foil, a second foil and a third foil, said first terminal is connected to said first copper foil, said third terminal in connected to said second copper foil, said second and fourth terminals are connected to said third copper foil.

* * * * *